US005728667A

United States Patent [19]

Richter

[11] Patent Number: 5,728,667

[45] Date of Patent: Mar. 17, 1998

[54] COMPOSITIONS CONTAINING ORGANIC COMPOUNDS

[75] Inventor: Alan F. Richter, Branchburg, N.J.

[73] Assignee: Reckitt & Colman Inc., Montvale, N.J.

[21] Appl. No.: 820,096

[22] Filed: Mar. 19, 1997

Related U.S. Application Data

[63] Continuation of Ser. No. 572,764, Dec. 14, 1995, abandoned.

[30] Foreign Application Priority Data

Oct. 25, 1995 [GB] United Kingdom ..... 9521837

[51] Int. Cl.[6] ..... C11D 1/06; C11D 1/62

[52] U.S. Cl. ..... 510/235; 510/237; 510/319; 510/433; 510/503; 510/504

[58] Field of Search ..... 510/235, 237, 510/219, 319, 530, 422, 433, 490, 504, 503

[56] References Cited

U.S. PATENT DOCUMENTS

| | | | |
|---|---|---|---|
| 4,264,457 | 4/1981 | Beeks et al. | 252/8.75 |
| 4,272,395 | 6/1981 | Wright | 252/106 |
| 4,493,773 | 1/1985 | Cook et al. | 252/8.8 |
| 4,576,729 | 3/1986 | Paszek et al. | 252/106 |
| 4,965,063 | 10/1990 | Casey et al. | 424/7.1 |
| 5,080,830 | 1/1992 | Damaso | 252/547 |
| 5,230,823 | 7/1993 | Wise et al. | 252/174.21 |
| 5,368,756 | 11/1994 | Vogel et al. | 252/8.8 |
| 5,378,409 | 1/1995 | Ofosu-Asante | 252/548 |
| 5,399,280 | 3/1995 | Woo et al. | 252/142 |
| 5,409,621 | 4/1995 | Ellis et al. | 252/8.8 |
| 5,415,813 | 5/1995 | Misselyn et al. | 252/547 |

FOREIGN PATENT DOCUMENTS

| | | |
|---|---|---|
| 0295093 A1 | 12/1988 | European Pat. Off. . |
| 698660 | 2/1996 | European Pat. Off. . |
| 7-233394 | 9/1995 | Japan . |

OTHER PUBLICATIONS

Precipitation Phenomena in Mixtures of Anionic and Cationic Surfactants in Aqueous Solutions, Stellner, Amante, Scamehorn and Harwell, Journal of Colliod and Interface Science, vol. 123, No. 1, May 1988.

Quaternary Ammonium Antimicrobial Compounds, Merianos, Chapter 13, pp. 225–255.

GB Search Report for GB 9516372.1 dated 29 Dec. 1995.

GB Search Report for GB 9521837.6 dated 23 Feb. 1996.

*Primary Examiner*—Douglas J. McGinty
*Assistant Examiner*—John R. Hardee
*Attorney, Agent, or Firm*—Fish & Richardson P.C.

[57] ABSTRACT

Germicidal light-duty dishwashing detergent composition in either a gel, liquid, or semi-liquid form, which consists essentially of:

0.5–2.75 parts quaternary ammonium germicidal compound 0.5–40 parts by weight of an anionic alkyl ether carboxylate surfactant of formula:

$$R—O—(C_2H_4O)_x—CH_2—COO^-M^+$$

where x is 4 to 11, R is a $C_{9-18}$alkyl, M is counterion;

10–40 parts by weight of an nonionic surfactant;

0.01–30 parts by weight of an of a suds boosting agent; water;

0–40 parts by weight of one or more additives, wherein the ratio of the quarternary ammonium germicidal agent to the anionic alkyl ether carboxylate surfactant is 1:1–4, and, the compositions exhibit a pH in the range of 5–10.

The compositions are excellent dishwashing detergents particularly suited for manual dishwashing operations, and further provide good cleaning with an effective sanitizing effect.

19 Claims, 1 Drawing Sheet

COMPOSITIONS CONTAINING ORGANIC COMPOUNDS

This is a continuation of application Ser. No. 08/572,764, filed 14 Dec. 1995, now abandoned.

The present invention relates to detergent compositions, particularly liquid or gel dishwashing detergent compositions which provide good detersive and physical characteristics, and further provide germicidal activity.

BACKGROUND OF THE INVENTION

The present invention relates to detergent compositions, particularly liquid or gel dishwashing detergent compositions of the type which are a general usage in many commercial and domestic environments. Such compositions are particularly suitable for use in hand washing of soiled dishes, cooking utensils, as well as in certain general duty cleaning applications; and their use is also known as hard surface cleaners, glass cleaners and in the hand washing of textiles and garments.

As is known to the relevant art, large numbers of dishwashing detergent formulations are presently commercially available. Generally they are liquid compostions which include a large proportion of one or more anionic detergent agents which are recognized as providing good detersive action, and which also provide good foaming characteristics. Such foaming characteristics are highly desirable in that in such types of detergents and in their use, consumer perceptions frequently associate superior detersive action with compositions which build and retain foam during a cleaning operation. Exemplary anionic detersive agents include known surfactant compositions such as those of the sulfonate type, such as alkylbenzene sulfonates or alkane sulfonates, which are frequently used in conjunction with a sulphate or alkyl ether sulphate. Such dishwashing detergent formulations frequently include further surface active agents which may provide good detersive effects, such as certain known nonionic surfactants, for example, alcohol ethoxylates, alkyl phenol ethoxylates, mono- or di-ethanol amines, as well as amine oxides. In many such commercially available formulations, the anionic sulfonate comprising anionic surfactant material is the predominant surfactant within said composition, as good foaming characteristics are generally associated with such anionic surfactants. The use of further surfactants, i.e., the nonionic surfactants, in such formulations is generally to provide yet further detersive effect to the compositions, as well as other physical characteristics. For example, certain nonionic surfactant compositions are known to be generally milder detergents for such cleaning applications. Thus, a dishwashing liquid detergent formulations including only nonionic surfactants in the absence of an anionic surfactant would not normally be expected to be successful, as the poor or non-foaming characteristics of nonionic surfactants would not likely be well received by consumers. Also, while it is known to those skilled in the art that nonionic surfactants are generally compatible with other classes of surfactants, i.e., anionic, cationic, other nonionic surfactants, as well as amphoteric surfactants, the converse is not true as the other classes of surfactants are not readily combinable with dissimilar classes. For example, it is known that anionic surfactants are generally not compatible with cationic materials.

Surfactants such as those described above are well known to the art and exemplary compositions are described in *McCutcheon's Detergents and Emulsifiers*, North American Edition, 1982; *Kirk-Othmer, Encyclopedia of Chemical Technology,* 3rd Ed., Vol. 22, pp. 346–387.

Also generally known to the art are cleaning compositions and compounds which feature germicidal activity, are useful in the diminishment or destruction of various forms of undesirable microorganisms, and thus provide a disinfecting or sanitizing effect. These include, for example, cleaning compositions based on bleach as well as cleaning compositions which include certain quaternary ammonium compounds known to have a sanitizing effect. It is also known that such quaternary ammonium compounds are cationic in nature, and thus would be expected to be incompatible in formulations where an anionic surfactant is present to any significant degree, as these would be expected to form a complex which would detract from the foaming characteristic imparted by the anionic surfactant, or the germicidal activity of the cationic quarternary ammonium compound, but most likely both activities. Due to this characteristic, the use of such quaternary ammonium compounds, is generally limited to cleaning compositions in applications other than dishwashing detergent compositions, viz., where good foam buildup and retention are not highly desirable properties for such a cleaning composition. Although known to be effective germicidal agents, quarternary ammonium compounds have not found widespread use in dishwashing detergent compositions as a germicidal active constituent, due to the desire to provide detergent compositions which have good foaming characteristics, which are readily and economically provided by certain anionic surfactant compositions. Notwithstanding this technical problem, various cleaning compositions comprising quarternary ammonium compounds are known.

For example, U.S. Pat. No. 5,080,830 teaches a water dispersible composition comprising a hydrophobic quaternary ammonium compound, a polyether derivative compound used as a dispersing agent and certain quaternary ammoniums salts which are used as a stabilizing agent for the aqueous formulations formed from these constituents.

U.S. Pat. No. 5,368,756 to Vogel et al. provides a rinse added fabric softening composition which comprises a mixture of certain diester quaternary ammonium compounds with a highly ethoxylated hydrophobic material and a liquid carrier, preferably water. The invention appears to be directed to limiting the formation of soap scum caused by the interaction of the diester quaternary ammonium compound with anionic detergent surfactants and/or detergency builders which may be entrapped in a fabric being treated.

U.S. Pat. No. 5,399,280 to Woo et al. provides certain hard surface detergent compositions comprising either a mixture of zwitterionic detergent surfactants or a low sudsing nonionic detergent surfactant with a suds reducing amount of a phosphorous containing alkoxylate which compound provides good suds regulation and maintains good spotting/filming and rinsing characteristics, and optionally, but preferably, a hydrophobic solvent which itself provides additional cleaning activity.

U.S. Pat. No. 5,409,621 to Ellis et al. teaches a fabric softening composition comprising a water insoluble quaternary ammonium compound and a nonionic stabilizing agent which may be an alkoxylated $C_8$–$C_{22}$ linear alcohol comprising on average 10 or more moles of an alkylene oxide or which may be a $C_{10}$–$C_{20}$ alcohol, or mixture thereof. These constituents are desirably provided in an aqueous carrier.

U.S. Pat. No. 5,415,813 to Misselyn et al. provides an all-purpose liquid cleaner in the form of a micromulsion which finds use in cleaning hard surfaces are cited to be effective in removing grease soils. All of these compositions provide a certain class of quaternary ammonium compounds; such compounds are cited as grease release agents.

U.S. Pat. No. 4,576,729 to Paszek et al. provides stable liquid disinfectant laundry detergent compositions which comprise a nonionic surfactant, a so called cryptoanionic surfactant and a quaternary ammonium compound which is effective as a germicidal active agent, as well as minor amounts of other nonessential ingredients. Therein is taught that a critical combination of a nonionic surfactant of an ethoxylated octyl or nonyl phenol with a cryptoanionic surfactant of the alkyl alkoxy carboxylate class and a quaternary ammonium germicide in a water carrier in particular ratios of nonionic surfactant:cryptoanionic surfactant:quaternary ammonium germicide, in the range of from 2:4:1 to 3.5:5:1 provide effective laundry detergent compositions which offer a germicidal effect and antisoil redeposition properties. The compositions are provided preferably in liquid form and may comprise other nonessential ingredients including foam stabilizers, anti-irritating agents, brighteners, fragrances, dyes, pH adjusters such as a buffer, or triethanol amine and a viscosity modifier such as ethanol. Therein, it was observed that the addition of the nonionic ethoxylated octyl and nonyl phenol surfactants were an essential constituent in order to provide both stability and good detersive action.

U.S. Pat. No. 4,493,773 to Cook et al. teaches certain low phosphate detergent compositions which include nonionic detergent surfactants, an alkyl polysaccharide detergent surfactant, and a cationic softening/anti-static compound which may be a quaternary ammonium cationic surfactant. In the aforesaid compositions, the nonionic surfactant is preferably one according to the formula $R(OC_2H_4)_nOH$ wherein R is a primary alkyl $C_{10-18}$ and n has an average value of from about 2 to 9. The alkyl polysaccharide detergent surfactant is one according to the formula $RO(R'O)_y(Z)_x$ wherein R is an alkyl hydroxalkyl alkylphenol, hydroxyalkyl phenol, alkyl benzyl or mixture of one or more of the above, wherein the alkyl groups comprise from 8 to 18 carbon atoms; where R' contains from about 2 to 4 carbon atoms, y is a value from 0 to about 12, each Z is a moiety derived from reducing saccharide containing 5 or 6 carbon atoms, and x is a number from about 1 to about 10. The quaternary ammonium cationic surfactant has two chains which contain an average from about 16 to about 22 carbon atoms.

U.S. Pat. No. 4,272,395 to Wright teaches a hard surface cleaning composition which comprises a quaternary ammonium compound as a germicidal active agent and a co-surfactant selected from the group consisting of: short chain anionic surfactants having $C_3$–$C_8$ in the hydrophobic group; low alkoxylated nonionic surfactants having 0–4 ethylene oxide and/or propylene oxide groups in the molecule, as well as mixtures thereof. Therein it is taught that compositions comprising a conventional anionic surfactant of more than 8 carbons in the hydrophobic group or conventional nonionic detergents having more than 4 ethylene oxide groups were found to be poor performers as compared with the short chain anionic surfactants of 3 to 8 carbon atoms and/or low alkoxylated nonionic surfactants having 0 to 4 ethylene oxide or propylene groups in the molecule. The compositions of the invention according to U.S. Pat. No. 4,272,395 preferably comprise 50–95 parts by weight of the quaternary ammonium, 5–50 parts by weight of the anionic surfactant and 0–20 parts by weight of the nonionic surfactant.

U.S. Pat. No. 5,378,409 to Ofusu-Asante et al. teaches a specific light duty liquid or gel dishwashing detergent composition which comprises a surfactant mixture (I) which includes: (a) 80 to 100% by weight of certain alkyl ethoxy carboxylates according to the formula $RO(CH_2CH_2O)_x CH_2COO^-M^+$; (b) 0 to 10% by weight of alcohol ethoxylate according to the formula $RO(CH_2CH_2O)_xH$ and (c) 0 to 10% of one or more soaps according to the formula $RCOO^-M^+$, (II) from 0.1%–4% calcium ions, and (c) from 0 to about 10% of a calcium chelating agent said to prevent the formation of calcium carbonate participates in the composition, such that the said dishwashing detergent composition in a 10% by weight aqueous solution exhibits a pH of from 7–11. The specification recites that the alkyl ethoxy carboxylate within the surfactant mixture does not comprise a calcium ion, and this Patent later teaches the selected addition of certain salts in order to introduce the calcium ions in specific weight percentages to the cleaning composition; the presence of the calcium ions are cited at providing good grease removal, storage stability, and skin mildness. The specification also recites the use of limited amounts of certain cationic quaternary ammonium compounds as a suds boosting agent.

U.S. Pat. No. 5,230,823 to Wise et al. teaches certain light duty or gel dishwashing detergent compositions which comprise from 5 to 70% by weight of a surfactant mixture comprising: (a) 80 to 100% of an alkyl ethoxy carboxylate of the formula: $RO(CH_2CH_2O)_xCH_2COO^-M^+$ wherein $M^+$ is a cation; (b) 0 to 10% of alcohol ethoxylates according to the formula: $RO(CH_2CH_2O)_xH$; (c) 0 to 10% of a soap based upon the formula: $RCOO^-M^+$, wherein a 10% by weight aqueous solution of the cleaning composition exhibits a pH of from 7–11. As opposed to U.S. Pat. No. 5,378,409 discuss supra, compositions according to U.S. Pat. No. 5,230,823 teaches the utility of ions, including magnesium and calcium ions of which magnesium ions are particularly preferred. Also taught as an optional constituent in the compositions according to Wise et al., are certain cationic quaternary ammonium surfactants which are taught to be as suds boosters, i.e., suds stabilizing surfactants.

While these patents may provide useful dishwashing detergent formulations, there remains a continuing need in the art for improvements to dishwashing detergent compostions, particularly the provision of diswashing detergent compositions providing good detersive and foaming characteristics, and an efficacious germicidal effect.

Therefore, it is an object of the invention to provide improvements in the cleaning compositions, more particularly to provide a foaming dishwashing detergent composition in a concentrated form, which further comprises an effective amount of a germicidal active agent.

It is a further object of the invention to provide a process for adding germicidal active agents in effective amounts to certain dishwashing detergent compositions.

It is still a further object of the invention to provide improved dishwashing detergent compositions in both concentrated and diluted (aqueous) form wherein said dishwashing detergent is characterized by good foaming, satisfactory detersive properties, and germicidal activity. Such compositions are particularly useful in hard surface cleaning applications such as in the cleaning of soiled dishes, utensils, hard surfaces, and the like. The compositions according to the invention also find use in certain textile and garment cleaning applications.

SUMMARY OF THE INVENTION

Figure 1:
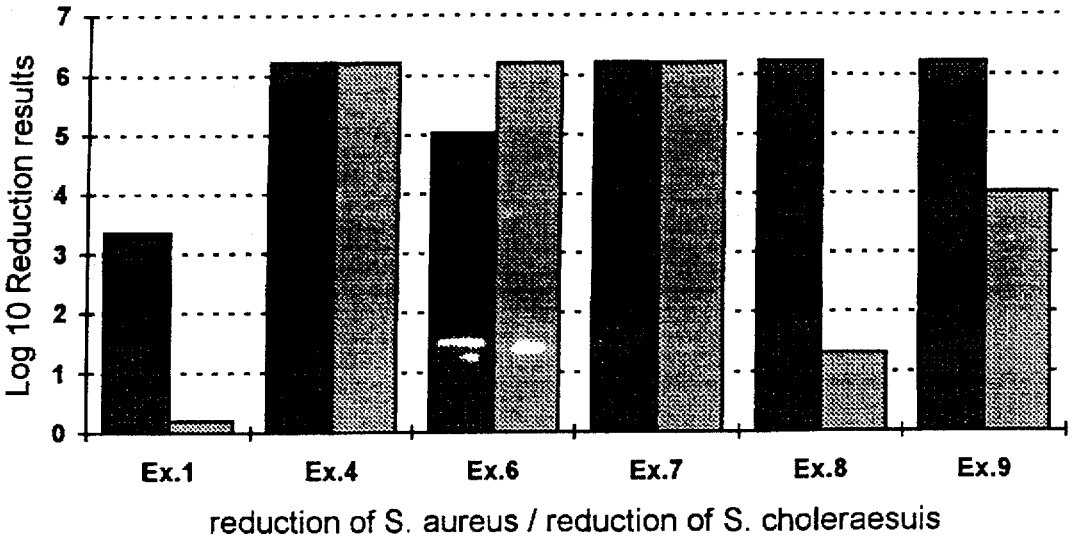
FIG. 1 illustrates the antimicrobial efficacy of certain compositions according to the invention.

The present invention provides a germicidal light-duty aqueous dishwashing detergent composition in either a gel, liquid, or semi-liquid form, which consists essentially in parts by weight of the following constituents:

A) 0.5–2.75 parts quarternary ammonium germicidal compound

B) 0.5–40 parts anionic alkyl ether carboxylate surfactant of formula:

$$R—O—(C_2H_4O)_x—CH_2—COO^-M^+$$

where x is 4 to 11, R is a $C_{9-18}$alkyl, M is a counterion;

C) 10–40 parts nonionic surfactant;

D) 0.01–30 parts of a suds stabilizing or suds boosting agent;

E) water.

The compositions may further include 0–40 parts by weight of one or more conventionally known and used additives, including but not limited to further surfactants particularly those which are effective to add further detersive effects and/or further suds boosting characteristics to the composition, visocosity modifying agents, foam stabilizing agents, sequestering agents, coloring agents, pH modifying agent (buffers), fragrances, fillers, optical brighteners, as well as one or more solubilizing/compatibilizing agents;

The aqueous dishwashing detergent compositions of the invention feature a pH in the range of 5–10, more preferably a pH in the range of 6–8, and most preferably a pH of about 7.

Component A

Useful germicidal agents in the compositions of the present invention include certain quaternary ammonium compounds and their salts which are also known as cationic surfactants. Examples of preferred cationic surfactant compositions useful in the practice of the instant invention include quarternary ammonium compounds and salts thereof may be characterized by the general structural formula:

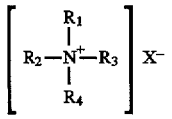

where at least one $R_1$, $R_2$, $R_3$ and $R_4$ is a hydrophobic, aliphatic, aryl aliphatic or aliphatic aryl radical of from 6 to 26 carbon atoms, and the entire cation portion of the molecule has a molecular weight of at least 165. The hydrophobic radicals may be long-chain alkyl, long-chain alkoxy aryl, long-chain alkyl aryl, halogen-substitued long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ether linkages. The radical X may be any salt-forming anionic radical.

Exemplary quarternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quarternary ammonium salts include those in which the molecule contains either amide or ether linkages such as octyl phenoxy ethoxy ethyl dimethyl benzyl ammonium chloride, N-(laurylcocoaminoformylmethyl)-pyridinium chloride, and the like. Other very effective types of quarternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quarternary ammonium compounds which act as germicides and which are be found useful in the practice of the present invention include those which have the structural formula:

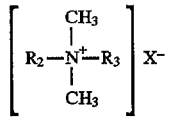

wherein $R_2$ and $R_3$ are the same or different $C_8$–$C_{12}$alkyl groups, or $R_2$ is $C_{12-16}$alkyl, $C_{8-18}$alkylethoxy, $C_{8-18}$alkylphenolethoxy group and $R_3$ is a benzyl group, and X may be any salt-forming anionic radical, but is preferably a halide, such as a chloride, bromide or iodide, or is a methosulfate radical. The alkyl groups recited in $R_2$ and $R_3$ may be straight chained or branched, but are preferably substantially linear.

Such quartenary germicides are usually sold as mixtures of two or more different quartenaries, such as BARDAC® 205M, (presently commercially available from Lonza, Inc., Fairlawn, N.J.) which is believed to be a 50% aqueous solution containing 20% by weight of an alkyl dimethyl benzylammonium chloride (50% C14, 40% C16 alkyl); 15% by weight of an octyl decyl dimethylammonium chloride; 7.5% by weight of dioctyl dimethylammonium chloride; and 7.5% by weight of didecyl dimethylammonium chloride. A further useful quarternary germicide is CYNCAL® 80% (presently commercially available from Hilton Davis Chemical Co., Cincinnati, Ohio) which is believed to comprise 80% by weight of an alkyl dimethyl benzylammonium chloride (50% C14, 40% C12 and 10% C16 alkyl), 10% water and 10% ethanol. Further useful quarternary germicidal agents include BTC-8358®, an alkyl benzyl dimethyl ammonium chloride (80% active) and BTC-818®, a dialkyl dimethyl ammonium chloride (both presently commercially available from the Stepan Chemical Co., Chicago, Ill.). Additional suitable commercially available quarternary ammonium germicides of the alkyl dimethyl benzylammonium chloride type containing the same alkyl dimethyl benzylammonium chloride mixture as that of CYNCAL® and which are generally referred to as quarternium salts include BARQUAT® MB-80, (presently commercially available from Lonza, Inc., Fairlawn, N.J.) which is believed to be and 80% by weight solution (20% ethanol) of the quarternary, HYAMINE® 1622 believed to be an aqueous solution of benzethonium chloride, and HYAMINE® 3500, which is believed to be a 50% aqueous solution of the quarternary (both presently commercially available from Lonza Inc., Fairlawn, N.J.).

In the compositions according to the invention, these cationic surfactants are desirably present in amounts of from 0.5 to 10 parts by weight. In preferred embodiments of compositions according to the invention, these cationic surfactants which desirably exhibit germicidal characteristics, are present in amounts of from 0.5–2.75 parts by weight, more desirably 0.5–2.5 parts by weight, still more desirably from 1–2.5 parts by weight and most desirably about 2 parts by weight. Likewise, in an aqueous cleaning composition formed by the addition of measured amounts of the composition described above to a larger volume of water, the cationic surfactant is preferably present in an amount of at least 50 parts per million ("ppm") in such an aqueous cleaning composition, and at these levels, the cationic surfactant generally provides an effective sanitizing effect under the usual conditions expected of a domestic manual dishwashing operation.

Constituent B

The anionic alkyl ether carboxylates useful in the practice of the instant invention include those having the general structural formula:

$$R—O—(C_nH_{2n}O)_m—R_1—COO^-M^+$$

wherein R is a straight or branched, long chain, alkyl group containing from 8 to 18 carbon atoms, n is an integer from 2 to 4, m is an integer from 1 to 100, $R_1$ is $CH_2$, $CH_2CH_2$, or $CH_2CH_2CH_2$, and M is a counterion such an an organic or inorganic cation including singly valent cations as well as polyvalent cations. Exemplary cations include cations of an alkali metal including sodium or lithium, or organic cations such as ammonium, diethylammonium, or triethylammonium cations, as well as other cations not particulary recited here. Such anionic alkyl ether carboxylates are known to be useful as surfactant compositions. In the compositions according to the instant invention, preferably n is 2, m is 4–11, R is $C_9$–$C_{16}$, $R_1$ is $CH_2$ and M is the cation of an alkali metal, preferably sodium. Such surfactants are presently commercially available under the trade name Sandopan® (Clariant Chemical Corp., Charlotte N.C.), Neodox®25-6 and Neodox®23-4 (Shell Chemical Co., Houston, Tex.), as well as Surfine® WLG(Finetex Inc., Elmwood Park, N.J.).

While the anionic alkyl ether carboxylate surfactant may be provided in its free acid form, it is most preferable to provide this surfactant in its salt form as it has been observed that the surfacant in its non-salt form features poor foaming action at reduced pH's, particularly in the pH range of from about 1 to 5, but when provided in its salt form provides good foaming behaviour particularly at the preferred pH ranges according to the present invention. When in free acid form, the anionic alkyl ether carboxylate surfactant is preferably neutralized for example by adding NaOH, KOH, or other base to the composition of the invention.

These anionic alkyl ether carboxylates are present in amount of from 0.5 to 40 parts by weight in the inventive compositions. Preferably the anionic alkyl ether carboxylate component is present in an amount of 2 to 10 parts by weight. It is further to be understood that mixtures of two or more different anionic alkyl ether carboxylates may also be used as Constituent B.

In particulary preferred embodiments, the anionic alkyl ether carboxylate component is present in particular proportions relative to the cationic surfactant composition according to Constituent A. Such proportions are in the range of cationic surfactant composition: alkyl ether carboxylate component of 1:1–4 preferably 1:1.5–3.5. It has been found that with such weight ratios, it has been observed that good foaming is observed while maintaining satisfactory antimicrobal activity. Values outside of these recited proportions may be used, however it has been observed by the inventor that ratios lower than those described above exhibit poorer foaming, while ratios higher than those described above have a reduced antimicrobal activity.

Constituent C

Suitable nonionic surfactants which can be used in the instant invention include water soluble nonionic surfactants, many which are well known and conventionally used in the art. Nonlimiting examples of nonionic surfactants which may be employed in the composition include those which are water soluble or water miscible and include one or more of the following: amine oxides, block copolymers, alkoxylated alkanolamides, ethoxylated alcohols, and ethoxylated alkyl phenols, and the like, with a more complete listing of commercially available nonionic surfactants found under these class listings in the "Chemical Classification" section of McCutcheon's *Emulsifier & Detergents North American Edition,* 1991.

Useful water soluble nonionic surfactants in the compositions according to the present invention include commercially well known surfactant compositions, including the primary aliphatic alcohol ethoxylates, secondary aliphatic alcohol ethoxylates, alkylphenol ethoxylates and ethylene-oxide-propylene oxide condensates of primary alkanols. These water soluble nonionic surfactants are generally the condensation products of an organic aliphatic or alkyl aromatic hydrophobic compound and hydrophilic ethylene oxide groups. Practically any hydrophobic compound having a carboxy, hydroxy, amido, or amine group with a free hydrogen attached to the nitrogen can be condensed with a hydrophilic group containing an ethylene oxide and/or with the polyhydration product thereof, polyethylene glycol, to form a water soluble nonionic surfactant.

Useful nonionic surfactants include the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide, tridecanol condensed with about 6 to moles of ethylene oxide, myristyl alcohol condensed with about 10 moles of ethylene oxide per mole of myristyl alcohol, the condensation product of ethylene oxide with a cut of coconut fatty alcohol containing a mixture of fatty alcohols with alkyl chains varying from 10 to about 14 carbon atoms in length and wherein the condensate contains either about 6 moles of ethylene oxide per mole of total alcohol or about 9 moles of ethylene oxide per mole of alcohol and tallow alcohol ethoxylates containing 6 moles ethylene oxide to 11 moles ethylene oxide per mole of alcohol.

A preferred group of the foregoing nonionic surfactants are certain ethoxylates presently commercially available under the trade name Neodol® (Shell Chemical Co., Houston, Tex.), which are believed to be higher aliphatic, primary alcohols containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol® 23-6.5), $C_{12-15}$ alkanol condensed with 12 moles ethylene oxide (Neodol® 25-12), $C_{14-15}$ alkanol condensed with 13 moles ethylene oxide (Neodol® 45-13), and the like. Such ethoxylates have an HLB (hydrophobic to lipophilic balance) value of about 8 to 15 and give good oil/water emulsification, whereas ethoxylates with HLB values below 8 contain less than 5 ethylene oxide groups and tend to be poor emulsifiers and poor detergents.

Additional satisfactory nonionic surfactant compositions include the condensation products of a secondary aliphatic alcohols containing 8 to 18 carbon atoms in a straight or branched chain configuration condensed with 5 to 30 moles of ethylene oxide. Examples of commercially available nonionic detergents of the foregoing type are those presently commercially available under the trade name of Tergitol® (Union Carbide Co., Danbury, Conn.) such as Tergitol® 15-S-12 which is described as being $C_{11}$–$C_{15}$ secondary alkanol condensed with 9 ethylene oxide units, or Tergitol®

15-S-9 which is described as being $C_{11}$–$C_{15}$ secondary alkanol condensed with 12 ethylene oxide units per molecule.

Other suitable nonionic surfactant compositions include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl condensed with about 9.5 moles of ethylene oxide per mole of nonyl phenol, dinonyl phenol condensed with about 12 moles of ethylene oxide per mole of phenol, dinonyl phenol condensed with about 15 moles of ethylene oxide per mole of phenol and diisoctylphenol condensed with about 15 moles of ethylene oxide per mole of phenol. Commercially available nonionic surfactants of this type include those which are presently commercially available under the trade name of Igepal® (Rhône-Poulenc, Princeton N.J.).

Also among the satisfactory nonionic surfactants which find use with the present inventive compostions are the water-soluble condensation products of a $C_8$–$C_{20}$ alkanol with a mixture of ethylene oxide and propylene oxide wherein the weight ratio or ethylene oxide to propylene oxide is from 2.5:1 to 4:1, preferably 2.89:1 to 3.3:1, with the total of the ethylene oxide; and propylene oxide (including the terminal ethanol or proponol group) being from 60–85%, preferably 70 to 80%, by weight. Such surfactants include those which are presently commercially available under the trade name of Plurafac® (BASF Corp., Hackettstown, N.J.). Further useful water-soluble condensation products of a $C_8$–$C_{20}$ alkanol with a mixture of ethylene oxide and/or propylene oxide include those which are presently marketed under the trade name Poly-Tergent® SL (Olin Chemical Co., Stamford Conn.) series of nonionic surfactants which are cited to comprise between 5 and 12 moles of oxyethylene per molecule.

Other suitable water-soluble nonionic detergents which are less preferred but which are nonetheless useful are those which are marketed under the trade name Pluronics® (BASF Corp., Hackettstown, N.J.). The compounds are formed by condensing ethylene oxide with a hydrophobic base formed by the condensation of propylene oxide with propylene glycol. The molecular weight of the hydrophobic portion of the molecule is of the order of 950 to 4,000 and preferably 200 to 2,500. The addition of polyloxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants are in liquid form and particularly satisfactory surfactants are available as those marketed as Pluronics® L62 and Pluronics® L64.

Alkylmonoglyocosides and alkylpolyglycosides which find use in the present inventive compositions include known nonionic surfactants which are alkaline and electrolyte stable. Alkyl monoglycosides and and alkylpolyglycosides are prepared generally by reacting a monosaccharide, or a compound hydrolyzable to a monosaccharide with an alcohol such as a fatty alcohol in an acid medium. Various glycoside and polyglycoside compounds including alkoxylated glycosides and processes for making them are disclosed in U.S. Pat. Nos. 2,974,134; 3,219,656; 3,598,865; 3,640,998; 3,707,535; 3,772,269; 3,839,318; 3,974,138; 4,223,129; and 4,528,106.

One exemplary group of such useful alkylpolyglycosides include those according to the formula:

$$R_2O—(C_nH_{2n}O)_r—(Z)_x$$

where Z is derived from glucose, R is a hydrophobic group selected from alkyl groups, alkylphenyl groups, hydroxyalkylphenyl groups as well as mixtures thereof, wherein the alkyl groups may be straight chained or branched, which contain from about 8 to about 18 carbon atoms, n is 2 or 3, r is an integer from 0 to 10, but is preferably 0, and x is a value from about 1 to 8, preferably from about 1.5 to 5. Preferably the alkylpolyglycosides are nonionic fatty alkylpolyglucosides which contain a straight chain or branched chain $C_8$–$C_{15}$ alkyl group, and have an average of from about 1 to about 5 glucose units per fatty alkylpolyglucoside molecule. More preferably, the nonionic fatty alkylpolyglucosides which contain straight chain or branched $C_8$–$C_{15}$ alkyl group, and have an average of from about 1 to about 2 glucose units per fatty alkylpolyglucoside molecule.

A further exemplary group of alkyl glycoside surfactants suitable for use in the practice of this invention may be represented by formula I below:

$$RO—(R_1O)_y—(G)_xZ_b \qquad \text{I}$$

wherein: R is a monovalent organic radical containing from about 6 to about 30, preferably from about 8 to about 18 carbon atoms; $R_1$ is a divalent hydrocarbon radical containing from about 2 to about 4 carbon atoms; O is an oxygen atom; y is a number which has an average value from about 0 to about 1 and is preferably 0; G is a moiety derived from a reducing saccharide containing 5 or 6 carbon atoms; and x is a number having an average value from about 1 to 5 (preferably from 1.1 to 2); Z is $O_2M^1$, $$—\overset{\overset{\displaystyle O}{\|}}{C}O—R_2,$$

$O(CH_2)$, $CO_2M^1$, $OSO_3M^1$, or $O(CH_2)SO_3M^1$; $R_2$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a $$—\overset{\overset{\displaystyle O}{\|}}{C}—OM^1$$

group); b is a number of from 0 to 3x+1 preferably an average of from 0.5 to 2 per glycosal group; p is 1 to 10, $M^1$ is $H^+$ or an organic or inorganic counterion, particularly cations such as, for example, an alkali metal cation, ammonium cation, monoethanolamine cation, or calcium cation.

As defined in Formula I above, R is generally the residue of a fatty alcohol having from about 8 to 30 and preferably 8 to 18 carbon atoms. Examples of such alkylglycosides as described above include, for example, APG™ 325 CS Glycoside® which is described as being a 50% $C_9$–$C_{11}$ alkyl polyglycoside, also commonly referred to as D-glucopyranoside, (commercially available from Henkel Corp, Ambler Pa.) and Glucopon™ 625 CS which is described as being a 50% $C_{10}$–$C_{16}$ alkyl polyglycoside, also commonly referred to as a D-glucopyranoside, (available from Henkel Corp., Ambler Pa.).

The nonionic surfactant can be present either singly, or a a mixture of two or more nonionic surfactant compounds as defined above. The nonionic surfactant in the present inventive compositions may be present in amount of up to about 40 parts by weight, and more preferably is present in amounts of about 10 to 30 parts by weight, most preferably the nonionic surfactant is present in amounts of 10 to 25 parts by weight. Desirably, at least 10% of the dishwashing detergent composition of the invention is an ethoxylated nonionic surfactant.

Constituent D

The compositions of the invention include one or more agents which are useful in stabilizing and or boosting the suds formed by the compositions. These agents include known art surfactant compositions, including betaines, ethylene oxide condensates, fatty acid amides, and amine oxide semi-polar nonionic surfactants.

Of known art betaine surfactants, particularly useful betaine surfactants include those according to the general formula:

$$R—N^{(+)}(R_1)_2—R_2C^{(-)}OO$$

$$R—\overset{(+)}{N}(R_1)_2—R_2\overset{(-)}{C}OO$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R_1$ is an alkyl group containing from 1 to about 3 carbon atoms; and $R_2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate.

Other suitable amidoalkylbetaines are disclosed in U.S. Pat. Nos. 3,950,417; 4,137,191; and 4,375,421; and British Patent GB No. 2,103,236, all of which are incorporated herein by reference.

Useful fatty acid amides which exhibit suds stabilizing effects include those which are known to the art. Particular exemplary amide surfactants which are useful suds stabilizers in the present inventive compositions include ammonia, monoethanol, and diethanol amides of fatty acids having an acyl moiety which contains from about 8 to about 18 carbon atoms, and which may be represented in accordance with the formula:

$$R_1—CO—N(H)_{m-1}—(R_2OH)_{m-3}$$

where $R_1$ represents a saturated or unsaturated aliphatic hydrocarbon radical of from about 7 to 21 carbon atoms, but preferably from about 11 to 17 carbon atoms; $R_2$ represents a $—CH_2—$ or $—CH_2CH_2—$, and m is an integer from 1 to 3, but is preferably 1. Preferably, $R_1$ is a saturated or unsaturated aliphatic hydrocarbon radical comprising from about 11 to 17 carbon atoms, and m is 1.

Non-limiting examples of such compounds as described immediately above include mono-ethanol amine coconut fatty acid amide and diethanol amine dodecyl fatty acid amide. The acyl moieties may be derived from naturally occuring glycerides, such as from coconut oil, palm oil, soybean oil, and tallow, or in the alternative may be synthetically produced for a variety of sources including by the oxidation of petroleum.

Examples of useful fatty acid amides include cocomonoethanol amide or cocodiethanolamide, which are presently commercially available as Monamid® CMA or Monamid® MDNA (Mona Industries, Paterson N.J.).

Known art amine oxide semi-polar nonionic surfactants which are useful as suds stabilizing agents may be included in the present inventive compositions. Non-limiting examples of useful amine oxide semi-polar nonionic surfactants include those according to the formula:

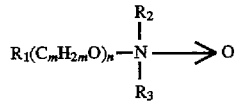

wherein $R_1$ is an alkyl, 2-hydroxyalkyl, 3-hydroxyalkyl, or 3-alkoxy-2-hydroxypropyl radical where the alkyl and alkoxy parts contain from about 8 to about 18 carbon atoms, $R_2$ and $R_3$ are independently selected from methyl, ethyl, propyl, isopropyl, 2-hydroxyethyl, 2-hydroxypropyl, or 3-hydroxypropyl, m is an integer from 2 to 4, and n is an integer from 0 to about 10. Preferably, the amine oxide semi-polar nonionic surfactants are those according to the formula immediately preceeding wherein $R_1$ is an alkyl radical of from 12 to 16 carbon atoms, $R_2$ and $R_3$ are independently selected from methyl or ethyl, m is 2, and n is 0.

Examples of such useful amine oxide semi-polar nonionic surfactants include cetyl-, myristil- or lauryl- dimethyl amine oxide or mixtures thereof. Such amine oxide semi-polar nonionic surfactants are known and are presently commercially available such as Surfox® MCO (Surfactants Inc., South Plainfield, N.J.), These compositions useful as suds stabilizers may be used individually, or in mixtures, and also, it is to be understood that certain non-ionic surfactants may also exhibit desirable suds stabilizing characteristics and may be used in the place of, or in addition to one or more of the suds stabilizers recited above. One example of such a non-ionic surfactant which exhibit suds stabilizing effects include ethoxylates of higher aliphatic, primary alcohols particularly alcohols containing about 9–15 carbon atoms.

The compositions which comprise Constituent D may be present in amounts of up to about 30 parts by weight, more preferably comprise from about 5 to about 25 parts by weight, and most desirably comprise from 10 to 20 parts by weight.

Constituent E:

The compostions according to the invention further include water which is added to the balance of the constituents present so to provide 100% by weight of the concentrate composition. The water may be tap water, but is preferably distilled and/or deionized water. If the water is tap water, it is preferably appropriately filtered in order to remove any undesirable impurities such as organics or inorganics, especially minerals salts which are present in hard water which may thus interfere with the operation of the diswashing detergent compositions according to the instant invention and formed therefrom.

Optional Constituent (Constituent F):

The compositions according to the invention may comprise one or more further optional constituents which may desirably included in certain formulations including, but not limited to; one or more further surface active agents, rheology modifying agents, neutralizing agents, chelating agents, sequestrants, coloring agents, solvents including alcohols such as ethanol and propylene glycol, hydrotropes such as sodium and potassium sulfonates, pH modifying agents (buffers), fragrances, fillers, optical brighteners, as well as one or more solubilizing/compatibilizing agents which may be desirable or necessary to improve the solubility/miscibility of one or more of the aforementioned constituents. Many of these are known to the art, and include those which are described in *McCutcheon's Functional Materials*, Vol. 2, North American Edition, (1991).

For the stabilization of the inventive composition the use of pH stabilizing agents, interchangeably referred to as pH buffers, the inclusion of any pH buffering compound or pH buffer composition which is compatible with the aqueous compositions taught herein may be used, including many which are well known to the art. Examples of such useful pH buffer compounds and/or pH buffering systems or compositions include the alkali metal phosphates, polyphospates, pyrophosphates, triphosphates, tetraphosphates, silicates, metasilicates, polysilicates, carbonates, hydroxides, and mixtures of the same. Certain salts, such as the alkaline earth phosphates, carbonates and hydroxides can also function as buffers. It is also suitable to use as certain organic materials generally referred to as gluconates, succinates, maleates, and their alkali metal salts. Such buffers keep the pH ranges of the compositions of the present invention within acceptable limits. Other pH buffers, not particularly elucidated here may also be used. Preferably, citric acid, such as is available in an anhydrous salt form of an alkali metal citric acid is added as it is readily commercially available, and effective. Citric acid is preferred as it is effective and is widely available at a low cost. The compositions of the instant invention exhibit a pH in the range of 5–10, more preferably a pH in the range 6–8, and and as noted above, most preferably a pH of about 7. The incorporation of an effective amount of such a pH stabilizing agent provides the technical benefits of ensuring the stability of the compositions of the invention as formulated, and as used when added to an excess of water to form a cleaning composition therefrom. As is known to those skilled in the relevant art, various stains and food deposits may impart an appreciable change in the pH of water from an approximately neutral pH to that of an acidic or basic pH. The inclusion of an effective amount of a pH stabilizing agent in the compositions, when added to the excess of water will tend to return the pH of a cleaning composition to a more neutral pH. While it will be realized that the selection of the other constituents forming the inventive compositions may necessitate varying amounts of a pH buffer composition, the buffer composition generally is included in any effective amount in order to bring about the desired pH adjustment, and is desirably not present in amounts exceeding about 10 parts by weight based on the total weight of the diswashing compositions according to the invention.

A further optional constituent which may be desirably included in the inventive compositions include a detergency builder component. Detergency builders, of the organic or inorganic type may be desirably included in the present inventive compositions. Exemplary builders include water soluble inorganic builders which can be used alone, in admixture with other water soluble inorganic builders, as well as in conjunction with one or more organic alkaline sequestrant builder salt. When present, the detergency builder component generally may be included in any effective amount, but preferably is not present in amounts exceeding about 10 parts by weight based on the total weight of the diswashing compositions according to the invention.

Exemplary detergency builders include alkali metal carbonates, phosphates, polyphosphates and silicates. More specific examples include sodium tripolyphosphate, sodium carbonate, potassium carbonate, sodium polyphosphate, potassium pyrophosphate, potassium tripolyphosphate, and sodium hexametaphosphate.

Exemplary organic alkaline sequestrant builder salts include alkali metal polycarboxylates including water-soluble citrates such as calcium, sodium and potassium citrate, calcium, sodium and potassium tartarate, calcium, sodium and potassium ethylenediaminetetraacetate, calcium, sodium and potassium N-(2-hydroxyethyl)-ethylene diamine triacetates, calcium, sodium and potassium nitrilo triacetates, as well as calcium, sodium and potassium tartrate mono- and di-succinates. As noted, these organic builder salts may be used individually, as a combination of two or more organic builder salts, as well as in conjunction with one or more detergency builders, including those indicated above. Of these, especially preferred are ethylenediaminetetraacetic acid, and salts thereof particularly calcium and sodium salts thereof, and hydroxyethylethylenediaminetriacetic acid and salts thereof particularly calcium and sodium salts thereof. Other known art chelating agents may be used, including sodium gluconate, gluconic acid and salts thereof and sorbitol may also be used.

As a further optional constituent, a composition which is effective in maintaining the duration of the suds over a period of time and/or foam height stability may also be included. Examples of such materials are known to the art, and include certain polyvalent salts such as water soluble salts of calcium and magnesium.

A further optional constituent includes one or more neutralizing agents, such as a base, i.e., KOH, NaOH, which may be desirably added to the compositions according to the invention, especially where the aninoic alkyl ether carboxylate is provided in a free acid form.

Further optional, but frequently desirable constituents include fragrances, which may be derived from natural sources or which may be synthetically produced. Such fragrances are known to the art, and may be added in any conventional manner, such as by admixing to a concentrate composition or blending with other constituents used to form a concentrate composition, in amounts which are found to be useful to enhance or impart the desired scent characteristic to the concentrate composition, and/or to cleaning compositions formed therefrom. Such fragrances are typically present in only minor amounts, and are generally not present in amounts exceeding 0.5 parts by weight.

If fragrances are included in the compositions of the invention, such fragrances may be difficult to solubilize without the further presence of a fragrance solubilizer constitutent. Accordingly, an effective amount of such a fragrance solubilizer may also be included in the inventive compositions, including known art compositions. Generally, such a fragrance solubilizer is present in only a minor amount, generally not exceeding 0.5 parts by weight.

Further optional, but advantageously included constituents are one or more coloring agents which find use in modifying the appearance of the concentrate compositions and enhance their appearance from the perspective of a consumer or other end user. Known coloring agents, may be incorporated in the compositions in any effective amount to improve or impart to concentrate compositions a desired appearance or color. Such a coloring agent or coloring agents may be added in a conventional fashion, i.e., admixing to a concentrate composition or blending with other constituents used to form a concentrate composition. Coloring agents are generally present in only minor amounts, and generally are not present in amounts to exceed 0.5 parts by weight.

The compositions according to the invention may be used in their concentrated form, i.e., in the form which it is intended to be marketed and sold to a consumer or the end user, but are usually expected to be diluted with a further excess of water in order to form a cleaning composition therefrom. What is to be understood by the term "composition" in this specification is the composition of the cleaning composition which is essentially the form of the product prepared for sale to the consumer or other end user. Such a consumer or other end user would then normally be expected to dilute the same with water to form a cleaning composition. It is to be understood however that nothing in this invention would bar its use as cleaning composition without any further dilution and it may be used in the concentrations in which it was prepared for sale. Similarly, what is to be understood by the term "cleaning compositions" as used in this specification are the water diluted compositions which are expected to be prepared by the consumer or other end user by mixing a measured amount of the "composition" with water in order to form an appropriately diluted cleaning composition which is suitable for use in cleaning applications, especially in dishwashing. Nothing in this specification, however, would bar an end user or consumer from using the composition directly, that is to say, without further dilution in water to form a cleaning composition therewith, nor from using the diswashing detergent composition, or a cleaning composition formed therefrom in other applications, such as a hard surface cleaner, or liquid soap for use in a laundry application, spot cleaning of textiles or garments, or as a personal care product, particulary as a liquid hand soap for providing both a cleaning and a sanitizing effect.

Cleaning compositions may be easily prepared by diluting measured amounts of the inventive compositions in water by the consumer or other end user in certain weight ratios of composition:water, and, agitating the same to ensure even distribution of the composition in the water. The water used in forming the cleaning composition may be at any temperature, and good results may be obtained at any temperature, especially at conventional temperatures used for known art compositions of this general class, viz., 20° C. and 40° C. As noted, the composition may be used without dilution, i.e., in composition:water concentrations of 1:0, to extremely dilute dilutions such as 1:10,000. Desirably, the concentrate is diluted in the range of 1:100–1:10,000, preferably in the range of 1:1–1:1000 but most preferably in the range of 1:100–1:600, with a dilution in the ratio of about 1:256 being typical of such a class of product. In order to attain satisfactory sanitizing effects, the cationic surfactant is preferably present in aqueous cleaning compositions in an amount of at least 50 parts per million ("ppm"), wherein in such an aqueous cleaning composition, the cationic surfactant generally provides an effective sanitizing effect under the usual conditions expected of a domestic manual dishwashing operation. It is to be understood however, that the actual dilution selected is in part determinable by the degree and amount of dirt and grime to be removed from the surfaces and articles being cleaned, the amount of mechanical force imparted to remove the same.

The inventor has surprisingly found that the judicious selection of the anionic surfactants allow for the production of shelf stable light duty aqueous dishwashing detergent composition which is readily dispersible in a further amount of water to form an aqueous cleaning composition therefrom, which has performance characteristics which are favorably comparable to known commercially available dishwashing detergent. What is surprising is that the present inventive compositions feature these performance characteristics while comprising a significant porportion of a cationic surfactant, and that such cationic surfactant imparts a germicidal effect to the dishwashing detergent composition and cleaning compositions formed therfrom. As is believed to be generally known in the art, cationic and anionic surfactants are not generally expected to be compatible in a liquid mixture as there is a tendency to form complexes between these surfactant species which renders both surfactant species useless. The present inventor has nonetheless found that in spite of such a technical prejudice, that by the careful selection of the various essential constituents in specific weight proportions an aqueous dishwashing detergent composition comprising both anionic and cationic surfactants, which also provided consumer acceptable foaming characteristics using these anionic and cationic surfactants, and which further provided a germicidal effect could be made. These dishwashing liquid compositions provide good detersive activity as the various classes of nonionic surfactants included in the composition provide varying chain lengths and degrees of ethoxylation/propoxylation which allows for the formulation of compositions which are effective over a broad range of food stains and residues, including fatty food soils and oily food soils.

In the preceeding specification, as well as in the examples below, unless otherwise specified, references to "part" and "parts by weight" are used interchangeably and weight percentages or weight proportions, are to be understood as parts by weight of the constituent being referred to based on 100 parts by weight of a composition.

While described in terms of the presently preferred embodiments, it is to be understood that the present disclosure is to be interepreted as by way of illustration, and not by way of limitation, and that various modifications and alterations apparent to one skilled in the art may be made without departing from the scope and spirit of the present invention. Examples provided below are to be understood as merely illustrative of the instant invention, and not are not be be understood as limiting the present inventive concept.

EXAMPLES

Formulations:

Various exemplary formulations were prepared by mixing measured amounts of the constituents into a glass vessel containing a volume of water less than that indicated on the Table 1 below. Mixing was performed with either the use of a manual stirrer, or in the alternative, a magnetic stirring rod and plate may have been used. The individual constituents were added in differing orders, as it was found that their order of addition to the water was of no consequence, and upon the conclusion of the addition of the constituents, a measured amount of water may have been added in order to bring the compositions up to 100 parts by weight. These exemplary formulations are illustrated on Table 1, below.

TABLE I

| ID # | Constituent: | Ex.1 | Ex.2 | Ex.3 | Ex.4 | Ex.5 | Ex.6 | Ex.7 | Ex.8 | Ex.9 |
|---|---|---|---|---|---|---|---|---|---|---|
| | | Example Formulations | | | | | | | | |
| 1 | Neodol ® 23-6.5[1] | 10.00 | — | — | — | — | — | — | — | — |
| 2 | Neodol ® 91-8[2] | — | 10.00 | 10.00 | 10.00 | 10.00 | 15.00 | 10.00 | 10.00 | 25.00 |
| 3 | Neodox ® 23-4[3] (78% wt. active) | 7.69 | 7.69 | — | 7.69 | 7.69 | — | 5.13 | — | — |
| 4 | Neodox 25-6[4] (78% wt. active) | — | — | 4.67 | — | — | — | — | 7.01 | 12.50 |
| 5 | Mackam ® DZ[5] (30% wt. active) | 16.67 | 16.67 | 16.16 | 16.67 | 16.67 | 16.67 | 16.16 | 8.08 | 41.25 |
| 6 | Monamid ® CMA[6] | 2.00 | 2.00 | 2.00 | 2.00 | 2.00 | 2.00 | 2.00 | 4.00 | — |
| 7 | Ninol ® 49-CE[7] | 4.00 | 4.00 | 4.00 | — | — | 3.00 | — | 4.00 | 15.00 |
| 8 | BTC 8358[8] (80% wt. active) | 2.50 | 2.50 | 2.50 | 2.50 | — | 2.50 | 2.50 | 2.50 | 6.25 |
| 9 | BTC 818[9] (50% wt. active) | — | — | — | 41.00 | — | — | — | — | — |
| 10 | Hyamine ® 1622[10] (50% wt. active) | — | — | — | — | 8.00 | — | — | — | — |
| 11 | Versene Na2[11] | — | — | — | — | — | — | 1.00 | — | — |
| 12 | Surfine ® WLG[12] (51% wt. active) | — | — | — | — | — | 5.88 | — | — | — |
| 13 | Surfox ® MCO[13] (30% wt. active) | — | — | — | — | — | — | — | 6.67 | — |
| 14 | distilled water | 57.14 | 57.14 | 60.70 | 57.14 | 53.10 | 54.95 | 62.70 | 57.74 | — |

[1]alcohol ethoxylate; described as having an average of 6.5 ethoxy units per molecule (Shell Chem. Co., Houston TX)
[2]alcohol ethoxylate; described as having an average of 8 ethoxy units per molecule (Shell Chem. Co., Houston TX)
[3]sodium alkyl ether carboxylate; described as having an average of 4 ethoxy units per molecule, neutralized with 50% NaOH aqueous solution (Shell Chem. Co., Houston TX)
[4]sodium alkyl ether carboxylate; described as having an average of 6 ethoxy units per molecule, neutralized with 50% NaOH aqueous solution (Shell Chem. Co., Houston TX)
[5]cocoamidopropylbetaine; (MacIntyre Group Ltd., University Park IL)
[6]cocomonoethanol amide; (Mona Industries Inc., Paterson NJ)
[7]cocodiethanol amide; (Stepan Chem. Co., Chicago IL)
[8]alkyl benzyl dimethyl ammonium chloride; (Stepan Chem. Co., Chicago IL)
[9]dialkyl dimethyl ammonium chloride; (Lonza Co., Fairlawn NJ)
[10]octyl phenoxy ethoxyethyl dimethyl ammonium chloride; (Lonza Co., Fairlawn NJ)
[11]disodium ethylene diamine tetraacetic acid; (Dow Chemical Co., Midland MI)
[12]sodium alkyl ether carboxylate; described as having an average of 7 ethoxy units per molecule (Finetex, Elmwood Park NJ)
[13]cetyl myristic amine oxide; (Surfactants Inc., South Plainfield NJ)

Additionally, a minor amount of an aqueous 10% sodium hydroxide solution was added to the formulations of Ex. 4, Ex. 5 and Ex. 7 was added to adjust the formulations to a pH of 7. Similarly, an aqueous 10% hydrochloric acid solution was added to the formulation of Ex. 3 to adjust it to pH of 7.

The functional categorization of each of the constituents noted in Table 1 above is described in Table 2, below. Note the consitutent identification numbers "ID#" for Table 1 and Table 2 are in direct correlation, and the Constituent Class, noted as "Const. Class" on Table 2 provides a correlation of the specific constituent and its function with respect to the defined invention.

TABLE 2

| ID # | Constituent: | Const. Class | Function |
|---|---|---|---|
| 1 | alcohol ethoxylate | C | nonionic surfactant |
| 2 | alcohol ethoxylate | C | nonionic surfactant |
| 3 | Sodium alkyl ether carboxylate | B | anionic surfactant |
| 4 | Sodium alkyl ether carboxylate | B | anionic surfactant |
| 5 | cocoamidopropylbetaine | D | suds stabilizer |
| 6 | cocomonoethanol amide | D | suds stabilizer |
| 7 | cocodiethanol amide | D | suds stabilizer |
| 8 | alkyl benzyl dimethyl ammonium chloride | A | quarternary ammonium germicidal agent |
| 9 | dialkyl dimethyl ammonium chloride | A | quarternary ammonium germicidal agent |
| 10 | octyl phenoxy ethoxyethyl dimethyl ammonium chloride | A | quarternary ammonium germicidal agent |
| 11 | disodium ethylene diamine tetraacetic acid | Optional | sequestrant |

TABLE 2-continued

| ID # | Constituent: | Const. Class | Function |
|---|---|---|---|
| 12 | sodium alkyl ether carboxylate | B | anionic surfactant |
| 13 | cetyl myristic amine oxide | D | suds stabilizer |
| 14 | distilled water | — | water |

Evaluation of Foaming

An evaluation of the foam heights of various of the Examples was performed by following generally, the protocol outlined in ASTM D1173-53 (Reapproved 1986) titled "Standard Test Method for Foaming Properties of Surface-Active Agents". The method was modified by using a 500 ml graduated cylinder as the faom receiver as well as by using a 1:1000 dilution of the tested composition.

Foam heights in the foam receiver were taken immediately. The results from the foam height evaluation are reported on Table 3 below.

TABLE 3

| Example No. | Foam Height (cm) |
|---|---|
| | Foam Heights |
| Ex. 1 | 7.5 |
| Ex. 2 | 12 |
| Ex. 3 | 7 |
| Ex. 4 | 6.5 |
| Ex. 5 | 12 |
| Ex. 6 | 6 |
| Ex. 7 | 7 |
| Ex. 8 | 8 |

TABLE 3-continued

| Foam Heights | |
|---|---|
| Example No. | Foam Height (cm) |
| Ex. 9 | 13 |
| Comp.1* | 13 |

*Dial Diswashing Detergent

As can be seen from the results reported in Table 3, the formulations according to the Examples featured favorable foaming characteristics when compared to a commercially available dishwashing detergent formulation based on anionic surfactants which class of surfactants are known to exhibit excellent foaming.

Antibacterial Efficacy - $Log_{10}$ Reduction Test

The antibacterial efficacy of certain formulations from the Examples of Table 1 were tested for antimicrobial activity against *Staphylococcus aureus* and *Salmonella choleraesuis* by a quantitative suspension test. The test was carried out for each of the Example formulations at dilution of one part of a respective Example's formulation to 256 parts of deionized water at 40° C. for a 10 minute contact time. The test protocol followed for each test was generally as follows.

1. Inoculation of the Samples:

A. Inoculate 1.0 ml of the 24 hour test culture into each 9.0 ml sample tube; and test in duplicate.

B. Subculture 1.0 ml of the sample after 10 minutes contact time with the respective diluted Example formulation.

C. Subculture the sample into 9.0 ml of DIFCO AOAC Letheen Broth to form a "$10^{-1}$ Sample" dilution.

2. Sample Dilutions and Plating

A. Plate the $10^{-1}$, $10^{-3}$, and $10^{-5}$ dilutions for each sample/organism/contact time combination by the following general protocol:

1. From the 10-1 "Sample" dilution, plate 1.0 ml to form a $10^{-1}$ "Sample" plate.
2. Pipet and transfer 0.1 ml of the $10^{-1}$ Sample dilution into 9.9 ml of DIFCO AOAC Letheen Broth to form a "$10^{-3}$ Sample" dilution and form a $10^{-3}$ plate.
3. Pipet and transfer 0.1 ml of $10^{-3}$ Sample dilution to 9.9 ml DIFCO AOAC Letheen Broth to form a "$10^{-5}$ Sample" dilution and form a $10^{-5}$ plate.

B. Pour each of the $10^{-1}$ plates, $10^{-3}$ plate, and $10^{-5}$ plate with Tryptic Soy Agar containing polysorbate 80 and lecithin (either DIFCO or BBL).

C. Incubate the plates for 48 hours at 35° C.

3. Control Counts: Dilutions and Plating

A. Inoculate 1.0 ml of 24 hour test culture into 9.0 ml DIFCO AOAC Letheen Broth to form a "Control" dilution.

B. Subculture 1.0 ml of the Control dilution into 9.0 ml DIFCO AOAC Letheen Broth at 10 minutes exposure; these are the "$10^{-1}$ Control" dilution tubes for the 10 minutes contact time controls.

C. Plate $10^{-4}$ and $10^{-5}$ dilution of the $10^{-1}$ Control dilution for each contact time by the following protocol:

1. Pipet 0.1 ml of the $10^{-1}$ Control dilution into 9.9 ml DIFCO AOAC Letheen Broth to form a "$10^{-3}$ Control" dilution.
2. Plate 1.0 ml of the $10^{-3}$ Control dilution into 9.0 ml DIFCO AOAC Letheen Broth to form a "$10^{-4}$ Control" dilution and form a "$10^{-4}$ Control" plate.
3. Pipet 0.1 ml of the $10^{-3}$ Control dilution into 9.9 ml of ml DIFCO AOAC Letheen Broth to form a "$10^{-5}$ Control" dilution, and to form a "$10^{-5}$ Control" plate.
4. Pour the $10^{-4}$ and $10^{-5}$ Control plates with Tryptic Soy Agar containing polysorbate 80 and lecithin, and incubate at 35° C. for 48 hr.

4. Calculation of $Log_{10}$ Reduction:

A. Determine the number of bacteria survivors at each contact time for both the controls and test samples of each of the plates produced in accordance with the protocols outlined for steps 1–3 denoted above.

1. Count the number of colonies on the petri dish. The plate is acceptable for counting with a colony count between 25 and 250.
2. Multiply the number of colonies by the plate dilution factor=the number of surviving bacteria/ml.

B. Determine the Log Reduction in bacteria for each sample/organism/contact time combination in accordance with the following equation:

$$Log_{10}\text{ (Control Count)}-Log_{10}\text{ (Survivor Count)}=\text{\#Logs of bacteria reduced by the sample.}$$

The results from this antibacterial efficacy evaluation are reported on Table 4 below.

TABLE 4

| Antibacterial Efficacy | | |
|---|---|---|
| Example: | Log Reduction of *Staphylococcus aureus* | Log Reduction of *Salmonella choleraesuis* |
| Ex.1 | 3.36 | 0.21 |
| Ex.4 | 6.22 | 6.21 |
| Ex.6 | 5.04 | 6.21 |
| Ex.7 | 6.22 | 6.21 |
| Ex.8 | 6.22 | 1.31 |
| Ex.9 | 6.22 | 4.02 |

With reference to the reported results of Table 4, and are illustrated on FIG. 1. It is to be understood that any Log 10 reduction value greater than a "2" indicates that at least 99% of the tested organisms have been destroyed and the composition has good germicidal properties. Any value greater than a "3" indicates indicates that at least 99.9% of the tested organisms have been destroyed and that the composition exhibits excellent germicidal properties. Higher values of Log 10 reduction indicate further improvements in germicidal activity with a Log 10 reduction value of "4" indicating that at least 99.99% of the tested organisms have been destroyed; a Log 10 reduction value of "5" indicating that at least 99.999% of the tested organisms have been destroyed, with higher Log 10 reduction values indicating still higher rates of germicidal efficacy.

Antibacterial Efficacy - AOAC Test

The antibacterial efficacy of certain formulations from the Examples of Table 1 was evaluated against two representative bacterial species, *Salmonella choleraesuis* and *Staphylococcus aureus*. As is known in the art, each of these bacterial species is commonly found in kitchen environments and foodstuffs, and is desirably removed or destroyed during a cleaning procedure.

Antimicrobial efficacy of the prepared dilutions according to examples were evaluated generally in accordance with the standardized AOAC Use-Dilution test method based on AOAC Official Methods of Analysis Procedures 955.14 "Testing disinfectants against *Salmonella Choleraesusis*," and Procedure 955.15 "Testing disinfectants against *Staphylococcus Aureus*" (15th Edition, 1990, pages 135–137, Use Dilution Methods). The results reported on Table 4 indicate the proportion of the number of sample test tubes within which the organism remained alive after 10 minutes of exposure at 40° C. over the total number of test tube samples used in testing the exemplary formulations of Table 1 for their germicidal activity.

A comparative sample of a commercially available product was also evaluated which was produced by diluting 1 part of a commercially available product, Dial® Dishwashing Liquid at "full strength", directly as packaged and without further dilution in water. The results from the antibacterial efficacy evaluation are reported on Table 5 below.

TABLE 5

| Antimicrobial Efficacy | | |
|---|---|---|
| Example No: | *Staphylococcus aureus* | *Salmonella choleraesuis* |
| Ex.3 | 0/20 | 0/20 |
| Ex.5 | 0/20 | 0/20 |
| Comp.1 | 30/30 | 28/30* |

As can be seen from the results reported in Table 5, the exemplary formulations featured excellent germicidal efficacy even when compared to a commercially available dishwashing detergent formulation used without dilution in water.

I claim:

1. Germicidal light-duty dishwashing detergent composition in either a gel, or liquid, which consists essentially of:

A) 0.5–2.75 parts by weight of quaternary ammonium germicidal compound,

B) 0.5–40 parts by weight of an anionic surfactant portion, wherein said portion consists of an anionic alkyl ether carboxylate surfactant of formula:

$$R—O—(C_2H_4O)_x—CH_2—COO^-M^+$$

where x is 4 to 11, R is a $C_{9-18}$alkyl, M is counterion;

C) 10–40 parts by weight of an nonionic surfactant,

D) 0.01–30 parts by weight of a suds stabilizing or suds boosting agent;

E) water;

F) 0–40 parts by weight of one or more additives, wherein the ratio of the quaternary ammonium germicidal agent to the anionic alkyl ether carboxylate surfactant is 1:1–4, and, the compositions exhibit a pH in the range of 5–10.

2. The composition according to claim 1 wherein the weight ratio of the quarternary ammonium germicidal compound to the anionic alkyl ether carboxylate surfactant is 1:1.5–3.5.

3. The composition according to claim 1 wherein the quarternary ammonium germicidal compound is compound according to the formula:

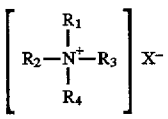

wherein:

at least one $R_1$, $R_2$, $R_3$ and $R_4$ is an aliphatic, aryl aliphatic or aliphatic aryl radical of from 6 to 26 carbon atoms, and the entire cation portion of the molecule has a molecular weight of at least 165.

4. The composition according to claim 3 wherein at least one $R_1$, $R_2$, $R_3$ and $R_4$ is a hydrophobic radical selected from long-chain alkyl, long-chain alkoxy aryl, long-chain alkyl aryl, halogen-substitued long-chain alkyl aryl, long-chain alkyl phenoxy alkyl, or aryl alkyl radicals, and, remaining $R_1$, $R_2$, $R_3$ and $R_4$ radicals on the nitrogen are substituents of a hydrocarbon structure containing a total of no more than 12 carbon atoms which may optionally include one or more amide or ether linkages.

5. The composition according to claim 1 wherein the quarternary ammonium germicidal compound is a compound according to the formula:

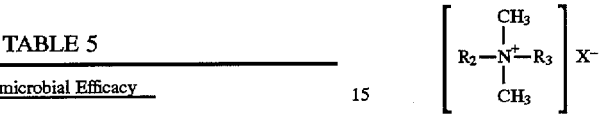

wherein:

$R_2$ and $R_3$ are the same or different $C_8$–$C_{12}$alkyl groups, or, $R_2$ is an $C_{12-16}$alkyl, $C_{8-18}$alkylethoxy, or $C_{8-18}$alkylphenolethoxy group and $R_3$ is benzyl; and, X is a salt forming anionic radical.

6. The composition according to claim 1 the anionic alkyl ether carboxylate surfactant is an anionic alkyl ether carboxylate according to the structural formula:

$$R—O—(C_2H_4O)_x—CH_2—COO^-M^+$$

wherein;

n is 2;

m is 4–11;

R is $C_9$–$C_{16}$, and,

M is the cation of an alkali metal.

7. The composition according to claim 1 wherein the nonionic surfactant is at least one of a condensation product of an organic aliphatic or alkyl aromatic hydrophobic compound having a carboxy, hydroxy, amido, or amino group with a free hydrogen attached to a nitrogen atom with hydrophilic group containing ethylene oxide and/or polyethylene glycol.

8. The composition according to claim 1 wherein the suds stabilizing or suds boosting agent is selected from: betaines, ethylene oxide condensates, fatty acid amides, and amine oxide semi-polar nonionic surfactants.

9. The composition according to claim 1 wherein the additives are one or more additives selected from: detersive enhancing additives, viscosity modifying agents, foam stabilizing agents, sequestering agents, neutralizing agents, coloring agents, pH modifying agents, pH buffers, fragrances, fillers, optical brighteners, solubilizing agents, and compatibilizing agents.

10. The composition according to claim 1 wherein the compositions exhibit a pH in the range of 6–8.

11. The composition according to claim 1 wherein the compositions exhibit a pH of about 7.

12. An aqueous cleaning composition comprising in parts by weight: one part of the composition according to claim 1 per 100 to 10,000 parts of water.

13. An aqueous cleaning composition according to claim 12 wherein the quarternary ammonium germicidal compound is present in at least 50 parts per million.

14. An aqueous cleaning composition comprising in parts by weight: one part of the composition according to claim 1 per about 256 parts water, wherein the aqueous cleaning composition exhibits at least a "2" log reduction against *Staphylococcus aureus* and *Salmonella choleraesuis* by a quantitative suspension test.

15. An aqueous cleaning composition according to claim 14 wherein the aqueous cleaning composition exhibits at least a "3" log reduction against *Staphylococcus aureus* and *Salmonella choleraesuis* by a quantitative suspension test.

16. A process for washing of soiled dishes or cooking utensils to provide both disinfecting and cleaning benefits thereto, which comprises the step of: washing said soiled dishes or cooking utensils in an aqueous composition which comprises the composition according to claim 1.

17. The composition according to claim 1 which consists essentially of:

A) 0.5–2.75 parts by weight of quaternary ammonium germicidal compound according to the formula:

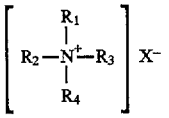

wherein:

at least one $R_1$, $R_2$, $R_3$ and $R_4$ is an aliphatic, aryl aliphatic or aliphatic aryl radical of from 6 to 26 carbon atoms, and the entire cation portion of the molecule has a molecular weight of at least 165;

B) 0.5–40 parts by weight of an anionic alkyl ether carboxylate surfactant of formula:

$$R—O—(C_2H_4O)_x—CH_2—COO^-M^+$$

where x is 4 to 11, R is a $C_{9-18}$alkyl, M is counterion;

C) 10–40 parts by weight of an nonionic surfactant;

D) 0.01–30 parts by weight of a suds stabilizing or suds boosting agent;

E) water;

F) 0–40 parts by weight of one or more additives, wherein the ratio of the quaternary ammonium germicidal agent to the anionic alkyl ether carboxylate surfactant is 1:1–4, and, the compositions exhibit a pH in the range of 5–10.

18. The composition according to claim 1 wherein the quaternary ammonium germicidal compound is present in an amount of from 0.5–2.5 parts by weight.

19. The composition according to claim 1 wherein the quaternary ammonium germicidal compound is present in an amount of from 1–2.5 parts by weight.

* * * * *